US009907404B1

(12) United States Patent
Sorel et al.

(10) Patent No.: US 9,907,404 B1
(45) Date of Patent: Mar. 6, 2018

(54) CONVERTIBLE SOFA

(71) Applicant: Herman Miller, Inc., Zeeland, MI (US)

(72) Inventors: Jess Sorel, Oakland, CA (US); David Simon, Zeeland, MI (US); Jon LeFors, San Francisco, CA (US); Howard Kaney, Sheboygan, WI (US); Gary Cruce, Sheboygan, WI (US)

(73) Assignee: Herman Miller, Inc., Zeeland, MI (US)

( * ) Notice: Subject to any disclaimer, the term of this patent is extended or adjusted under 35 U.S.C. 154(b) by 295 days.

(21) Appl. No.: 14/929,552

(22) Filed: Nov. 2, 2015

Related U.S. Application Data

(60) Provisional application No. 62/073,189, filed on Oct. 31, 2014.

(51) Int. Cl.

| | |
|---|---|
| ***A47C 17/04*** | (2006.01) |
| ***A47B 83/02*** | (2006.01) |
| ***A47C 17/165*** | (2006.01) |
| ***A47C 7/68*** | (2006.01) |
| ***A47B 21/02*** | (2006.01) |
| ***A47C 7/72*** | (2006.01) |

(52) U.S. Cl.
CPC ..... *A47C 17/1655* (2013.01); *A47B 21/02* (2013.01); *A47B 83/02* (2013.01); *A47C 7/68* (2013.01); *A47C 7/725* (2013.01); *A47C 17/04* (2013.01); *A47C 17/045* (2013.01)

(58) Field of Classification Search
CPC ..... A47C 17/045; A47C 17/16; A47C 17/161; A47C 17/162; A47C 17/165; A47C 17/1655; A47C 17/62; A47B 85/06; A47B 23/046; A47B 2023/048
See application file for complete search history.

(56) References Cited

U.S. PATENT DOCUMENTS

| | | | |
|---|---|---|---|
| 1,357,567 | A | 11/1920 | Jengiowski |
| 1,399,342 | A | 12/1921 | Gunn |
| 1,787,245 | A | 12/1930 | Graham et al. |
| 2,102,980 | A | 12/1937 | Spanglet |

(Continued)

FOREIGN PATENT DOCUMENTS

| | | |
|---|---|---|
| EP | 0916288 | 5/1999 |
| EP | 0945089 | 9/1999 |

(Continued)

*Primary Examiner* — David E Sosnowski
*Assistant Examiner* — Rahib T Zaman
(74) *Attorney, Agent, or Firm* — Michael Best & Friedrich LLP

(57) ABSTRACT

A convertible sofa includes a seat and a backrest moveable between a first configuration, in which the backrest is positioned along a back of the seat, and a second configuration, in which the backrest overlies an upper support surface of the seat. The sofa also includes a side wall positioned adjacent a side of the seat to define a recess that forms a leg opening. The sofa further includes a worksurface moveable between a first position, in which the worksurface is disposed within the recess and substantially aligned with a plane defined by the upper support surface of the seat, and a second position, in which the worksurface is spaced above the plane defined by the upper support surface of the seat. At least a portion of the worksurface is covered by the backrest when the worksurface is in the first position and the backrest is in the second configuration.

20 Claims, 6 Drawing Sheets

(56) References Cited

U.S. PATENT DOCUMENTS

| | | | | | |
|---|---|---|---|---|---|
| 2,159,494 | A | | 5/1939 | Wright | |
| 2,240,748 | A | | 5/1941 | Bak | |
| 2,534,176 | A | | 12/1950 | Lorenz | |
| 2,716,775 | A | * | 9/1955 | Kenimer | A47C 13/005 16/357 |
| 2,942,649 | A | | 6/1960 | Wells | |
| 3,088,127 | A | | 5/1963 | Eames | |
| 3,866,548 | A | | 2/1975 | Skonieczny | |
| 3,905,053 | A | * | 9/1975 | Vuchelich | A47C 17/1655 5/17 |
| 3,957,302 | A | * | 5/1976 | Jones | A47B 83/02 297/126 |
| 4,287,835 | A | * | 9/1981 | Stratton | A47B 23/046 108/26 |
| 4,506,927 | A | * | 3/1985 | Lombardo | A47C 13/00 297/118 |
| 4,879,962 | A | | 11/1989 | Lathers | |
| 5,088,135 | A | * | 2/1992 | Violette | A47C 17/34 297/146 |
| 5,104,182 | A | | 4/1992 | Rasnick et al. | |
| 5,280,656 | A | * | 1/1994 | Gossett | A47C 17/04 297/118 |
| 5,322,344 | A | | 6/1994 | Hoffman et al. | |
| 5,335,962 | A | | 8/1994 | Gera | |
| 5,374,108 | A | | 12/1994 | Saul et al. | |
| 5,524,959 | A | * | 6/1996 | Scott | A47C 7/68 297/125 |
| 6,929,321 | B1 | | 8/2005 | Shrock | |
| D715,576 | S | | 10/2014 | Hagleitner | |
| D176,576 | S | | 11/2014 | Wieland et al. | |
| 9,027,178 | B2 | | 5/2015 | Wieland et al. | |
| 9,125,496 | B2 | | 9/2015 | Wieland et al. | |
| 2005/0000020 | A1 | | 1/2005 | Schermel | |
| 2005/0253424 | A1 | * | 11/2005 | Thomas | A47B 85/04 297/119 |
| 2006/0162066 | A1 | | 7/2006 | Glattstein et al. | |
| 2010/0235985 | A1 | | 9/2010 | Singer | |
| 2013/0047333 | A1 | * | 2/2013 | Wieland | A47B 83/04 5/3 |
| 2015/0158400 | A1 | | 6/2015 | Yin et al. | |

FOREIGN PATENT DOCUMENTS

| | | |
|---|---|---|
| EP | 1645208 | 4/2006 |
| FR | 1494269 | 9/1967 |
| FR | 2566250 | 12/1986 |
| WO | 2003073891 | 9/2003 |

* cited by examiner

FIG. 6
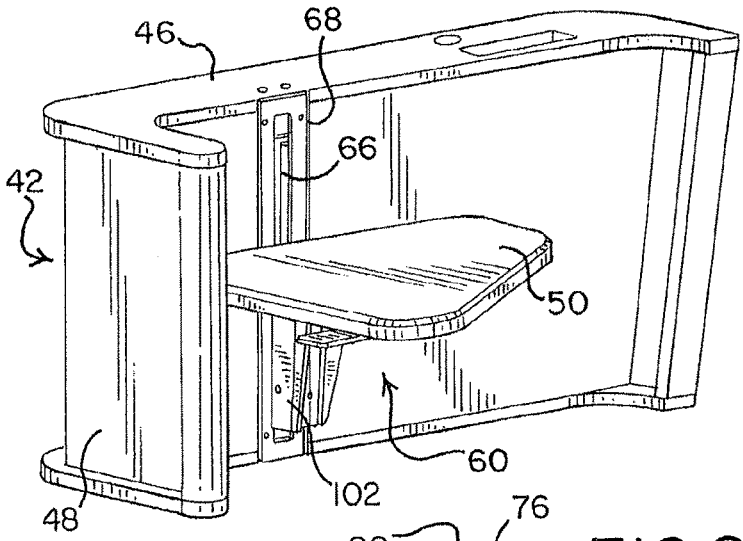
FIG. 8
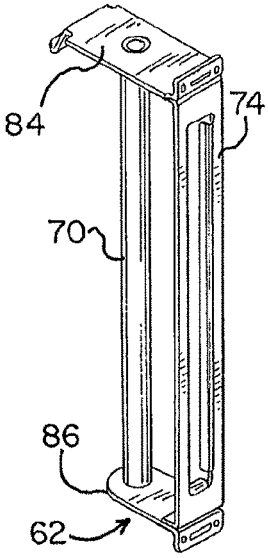
FIG. 9
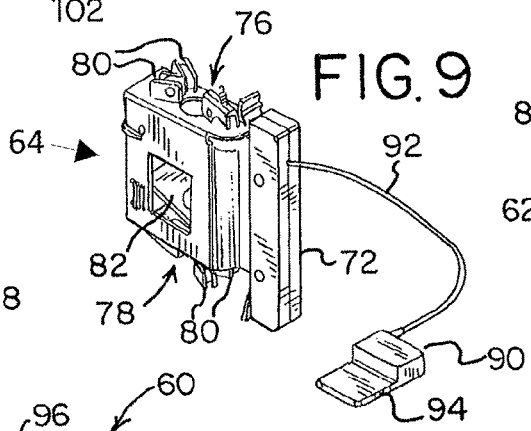
FIG. 7
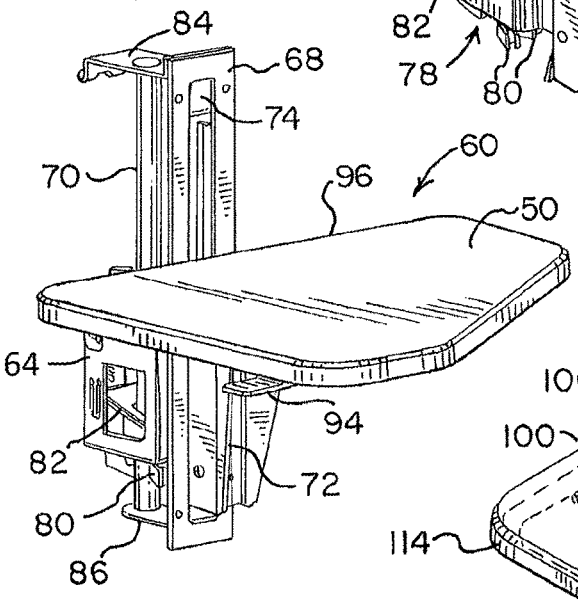
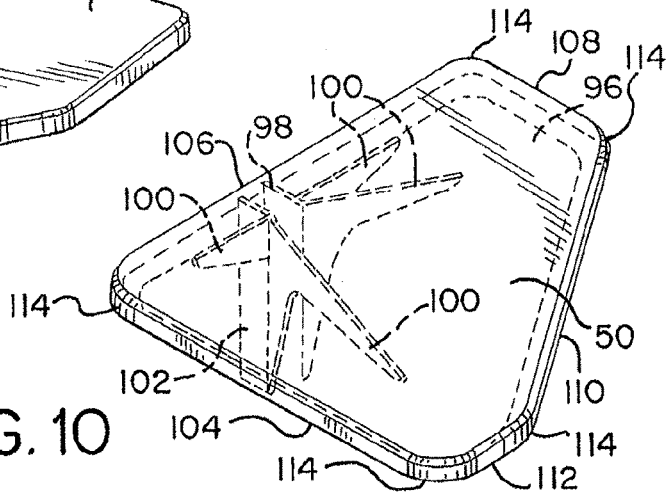
FIG. 10

CONVERTIBLE SOFA

CROSS-REFERENCE TO RELATED APPLICATIONS

This application claims priority to U.S. Provisional Patent Application No. 62/073,189, filed Oct. 31, 2014, the entire contents of which are incorporated by reference herein.

TECHNICAL FIELD

The present application is directed to a convertible sofa, and in particular, a convertible sofa having a seat, a back, and a worksurface.

BACKGROUND

Sofas convertible between a seating configuration and a sleeping configuration are well known. Such systems are useful for confined spaces, which may not have sufficient room for different pieces of furniture. In some instances, such systems may also include a table or worksurface. For example, in small multi-purpose rooms, such as hospital patient rooms, dormitory rooms, hotels, and the like, such systems allow for the user to use the furniture as a seat, a bed, or a table. Problematically, the worksurface or table portion may be bulky, heavy and/or difficult to manipulate or store. Often, such systems do not also maintain the worksurface and/or support structure within the footprint of the system. Moreover, such systems typically do not provide for utility outlets, lighting, or other accessories adjacent the worksurface.

SUMMARY

In one embodiment, the invention provides a convertible sofa including a seat having an upper support surface, a back, a front, a first side, and a second side. The front is shorter than the back. The convertible sofa also includes a backrest moveable between a first configuration, in which the backrest is positioned along the back of the seat, and a second configuration, in which the backrest overlies the upper support surface of the seat. The convertible sofa further includes a side wall positioned adjacent the first side of the seat. The side wall and the first side define a recess that forms a leg opening along the first side. The convertible sofa also includes a worksurface coupled to the side wall and moveable between a first position, in which the worksurface is disposed within the recess and substantially aligned with a plane defined by the upper support surface of the seat, and a second position, in which the worksurface is spaced above the plane defined by the upper support surface of the seat. At least a portion of the worksurface is covered by the backrest when the worksurface is in the first position and the backrest is in the second configuration.

In another embodiment, the invention provides a method of using a convertible sofa. The method includes providing a seat having an upper support surface, a back, a front, a first side, and a second side. The front is shorter than the back. The method also includes providing a side wall positioned adjacent the first side of the seat. The side wall and the first side define a recess forming a leg opening along the first side. The method further includes moving a worksurface between a first position, in which the worksurface is disposed within the recess and substantially aligned with a plane defined by the upper support surface of the seat, and a second position, in which the worksurface is spaced above the plane defined by the upper support surface of the seat. The method also includes moving a backrest between a first configuration, in which the backrest is positioned along the back of the seat, and a second configuration, in which the backrest overlies the upper support surface of the seat and at least a portion of the worksurface when the worksurface is in the first position.

In some embodiments, various utility outlets, lighting components, storage, and/or other accessories are supported by the side wall adjacent the worksurface.

Other aspects of the invention will become apparent by consideration of the detailed description and accompanying drawings.

BRIEF DESCRIPTION OF THE DRAWINGS

FIG. 6 is a perspective view of a side wall of the convertible sofa with a worksurface assembly attached thereto.

FIG. 7 is a perspective view of the worksurface assembly.

FIG. 8 is perspective view of a worksurface support of the worksurface assembly.

FIG. 9 is a perspective view of a worksurface carriage of the worksurface assembly.

FIG. 10 is a perspective view of a worksurface of the worksurface assembly.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

The terms "front," "back," "top," "left," "right," "upper," "bottom" and "lower" are intended to indicate directions when viewing a convertible sofa when seated therein and positioned for use. It should be understood that the term "plurality," as used herein, means two or more. The term "coupled" means connected to or engaged with, whether directly or indirectly, for example with an intervening member, and does not require the engagement to be fixed or permanent, although it may be fixed or permanent. It should be understood that the use of numerical terms "first," "second," "third," etc., as used herein does not refer to any particular sequence or order of components; for example, "first" and "second" components may refer to any sequence of such components, and is not limited to the first and second components of a particular configuration unless otherwise specified.

Figure 11:
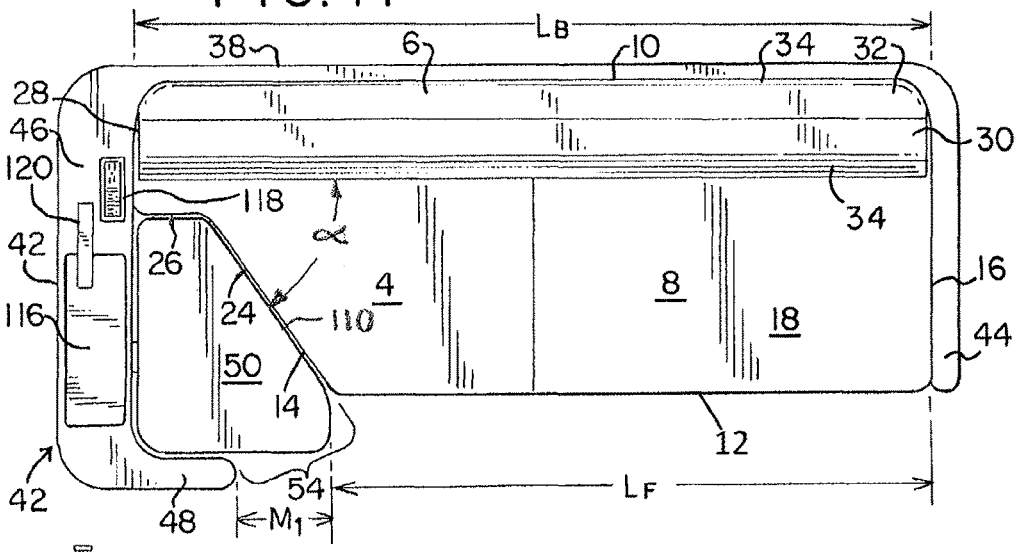
FIG. 11 is a top view of the convertible sofa shown in FIG. 1.
Figure 12:
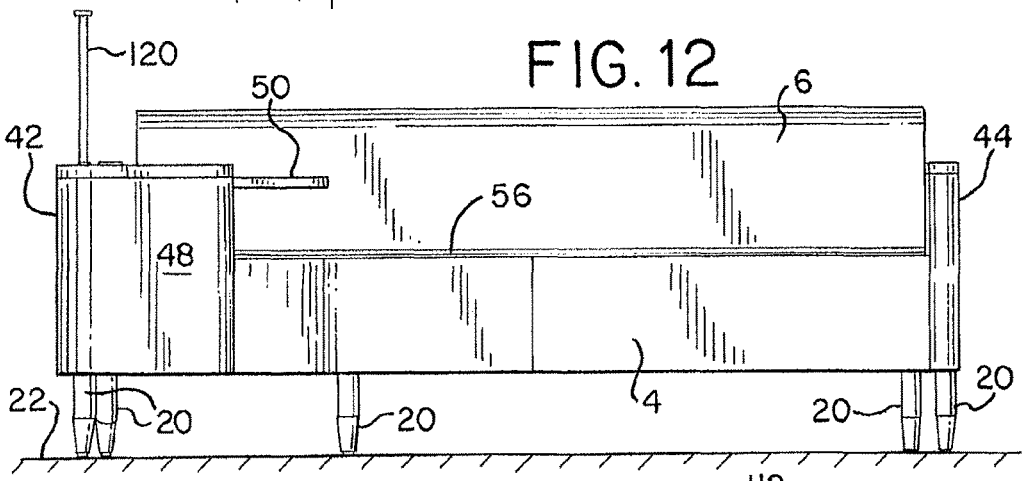
FIG. 12 is a front view of the convertible sofa shown in FIG. 1.
Figure 13:
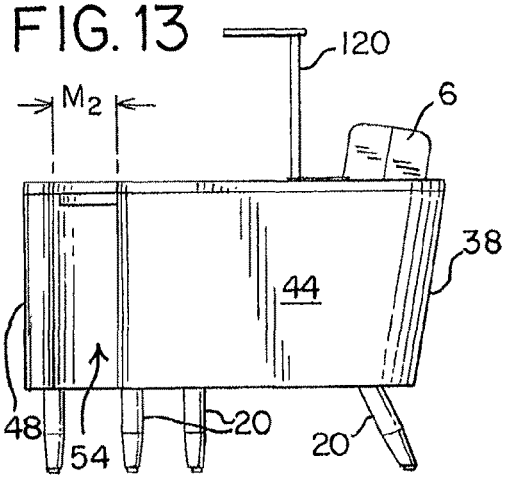
FIG. 13 is a side view of the convertible sofa shown in FIG. 1.

Referring to FIGS. 1-5 and 11-14, one embodiment of a convertible sofa 2 includes a seat 4 having an upper support surface 8, a back 10, a front 12, and first and second sides 14, 16. In the illustrated embodiment, the back 10, the front 12, and the sides 14, 16 are generally planar surfaces and define a perimeter of the seat 4. As shown in FIG. 11, the front 12 is shorter than the back 10, or has a length LF less than a length LB. The seat 4 may be configured as one or more cushions, which are supported by a base or frame. A user interface layer 18, such as a fabric, may overlie and cover the cushion and frame. The seat 4 may extend all of the way to the floor, or as shown in FIGS. 11-13, a plurality of legs or feet 20 may position a bottom of the seat 4 at a spaced apart location for an underlying support surface 22, such as a floor. As shown in FIG. 11, the first side 14 (shown as the right side in FIGS. 1, 2, 11 and 12 and as the left side in FIG. 14) of the seat 14 is notched, with an angled first portion 24 extending from the front 12, a second portion 26 parallel to the front 12, and a third portion 28 parallel to the second side 16 and perpendicular to the front 12.

Figure 1:
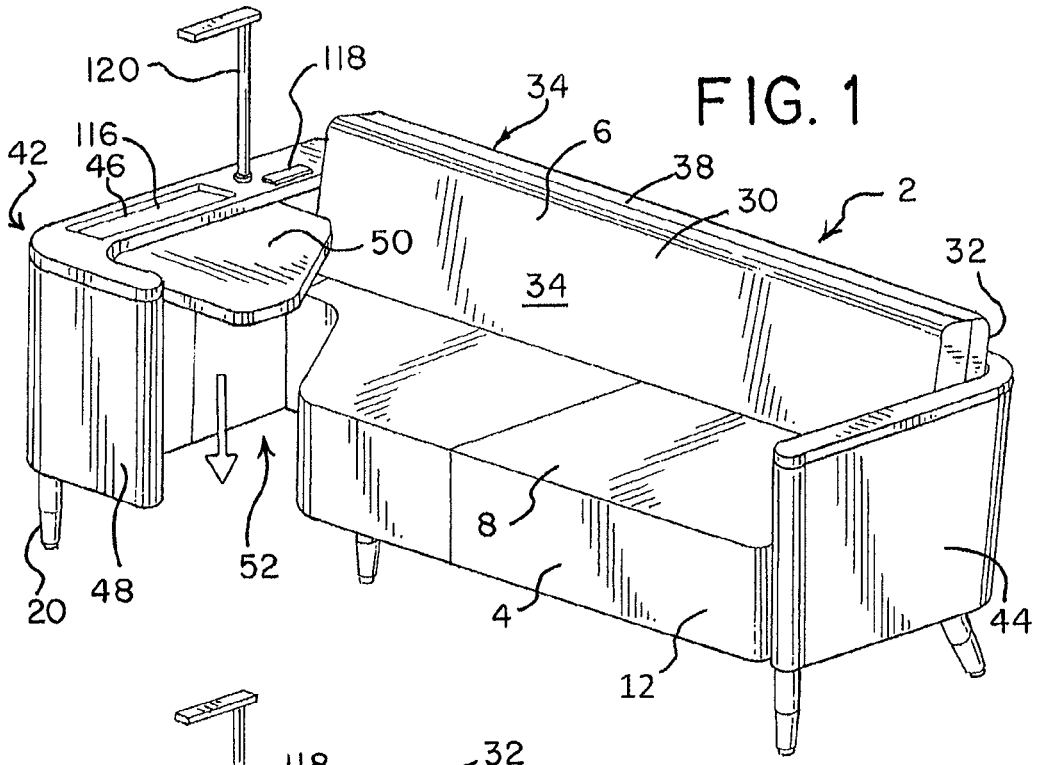
FIG. 1 is a perspective view of one embodiment of a convertible sofa in a sitting/work configuration.
Figure 2:
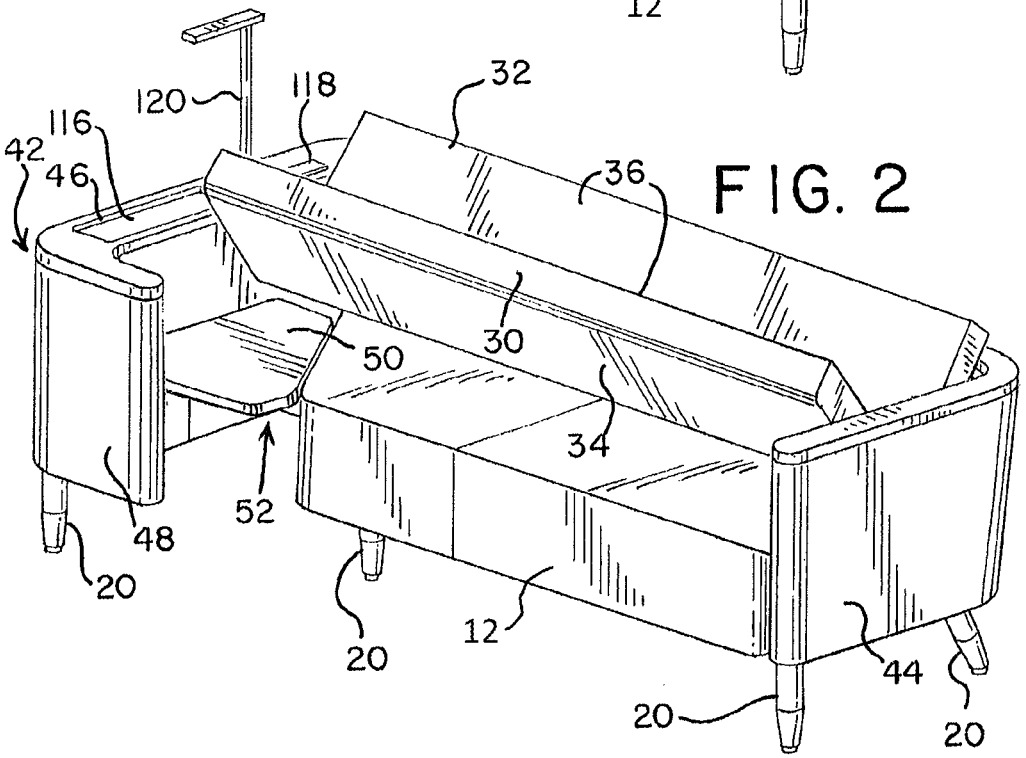
FIG. 2 is a perspective view of the convertible sofa shown in FIG. 1 being moved to a sleep configuration.
Figure 3:
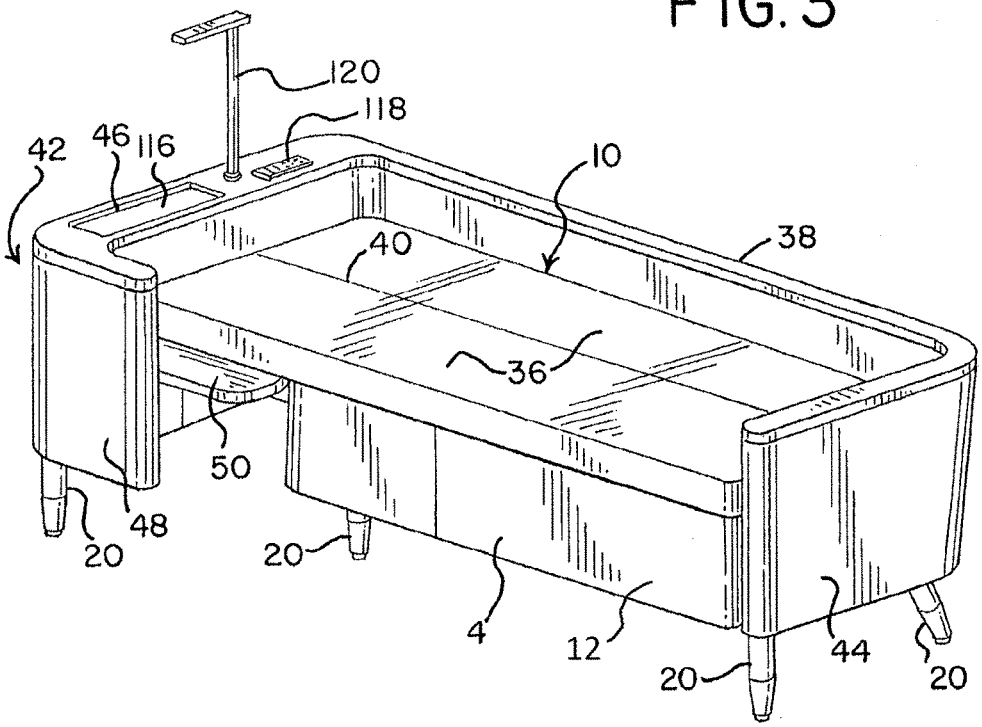
FIG. 3 is a perspective view of the convertible sofa shown in FIG. 1 in the sleep configuration.
Figure 4:
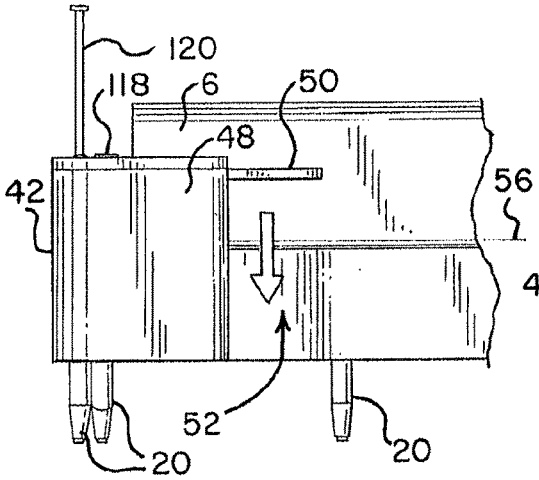
FIG. 4 is a front view of a portion of the convertible sofa shown in FIG. 1.
Figure 5:
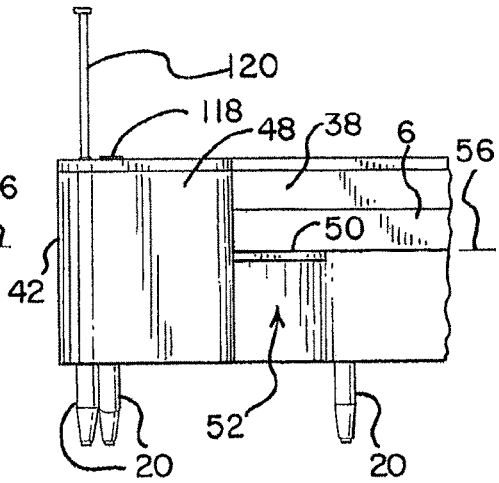
FIG. 5 is a front view of a portion of the convertible sofa shown in FIG. 3.

As shown in FIGS. 1-3, the convertible sofa 2 also includes a backrest 6. The illustrated backrest 6 includes a first portion 30 pivotally connected to a second portion 32. Each of the first and second portions 30, 32 has a first surface 34 and a second surface 36. The backrest 6 is moveable between first and second configurations, shown in FIGS. 1 and 3, respectively. The first configuration is also referred to as a sitting/work configuration, and the second configuration is also referred to as a sleep configuration. In the first configuration (FIG. 1), the backrest 6 is positioned along the back 10 of the seat 4 and overlies a rear portion of the upper surface 8, but leaves exposed a majority of the upper surface 8 of the seat 4 for sitting and/or lying thereon. In this configuration, the first and second portions 30, 32 are folded together. A rear wall 38 of the sofa 2, which is connected to the seat 4, provides support for the backrest 6. In some embodiments, the backrest 6 is not attached or secured to any other structures. In other embodiments, one or both of the first and second portions 30, 32 of the backrest 6 are secured to one or both of the rear wall and seat, for example with a tether. In either arrangement, the backrest 6 may be moved between the first configuration and the second configuration, as shown in FIG. 2. In the second configuration (FIG. 3), the backrest 6 overlies and covers substantially an entirety of the upper support surface 8 of the seat 4 and at least a portion of a worksurface 50. In this configuration, the first and second portions 30, 32 are unfolded to lay flat next to each other. The backrest 6 is extremely light and is easily grasped and moveable between the first and second configurations without the need for expensive, heavy and difficult to manipulate linkages. The backrest 6 may be made of various materials, including a foam interior covered with fabric upholstery.

The first surfaces 34 of the first and second portions 30, 32 define a front and a back of the backrest 6 when the backrest 6 is in the first configuration. In contrast, the second surfaces 36 of the first and second portions 30, 32 face, and more particularly contact, each other when the backrest 6 is in the first configuration. The second surfaces 36 of the first and second portions 30, 32 also define an upper surface of the backrest 6 when the backrest 6 is in the second configuration, depending on how the backrest 6 is unfolded. For example, as shown in FIG. 2, the first and second portions 30, 32 are connected along a bottom of the backrest with a hinge 40, such that the first portion 30 is unfolded downwardly and the backrest is pulled outwardly until the first and second portions 30, 32 are substantially co-planar, with the second surfaces 36 in combination defining a substantially planar bedding surface. In another embodiment, the hinge 40 may be positioned along the top of the backrest 6, and the first portion 30 may be unfolded upwardly so the backrest 6 is pulled outwardly until the portions 30, 32 are substantially co-planar. In this embodiment, the second surfaces 36 of the first and second portions 30, 32 would define a lower surface of the backrest 6 when the backrest 6 is in the second configuration. In other embodiments, the backrest 6 may be unfolded, and then positioned on the seat 4 in either orientation. In any of these arrangements, the first surfaces 34 of the first and second portions 30, 32 define the other of the upper or lower surface of the backrest 6 when the backrest 6 is in the second configuration. The first and second portions 30, 32 are joined by the hinge 40, which may be configured as a living hinge formed from a piece of fabric covering the first and second portions 30, 32.

Referring to FIGS. 1-6 and 11-14, the convertible sofa 2 includes a pair of side walls 42, 44 coupled to and extending forwardly from the rear wall 38. In one embodiment, one of the side walls 42 (e.g., the left side wall in FIGS. 1-3 and the right side wall in FIG. 14) has a greater thickness than the other side wall 44 and the rear wall 38, which may have the same or different thicknesses, so as to accommodate various accessories. For example, in one embodiment, the side wall 42 has a side portion 46 and a front portion 48 extending laterally inwardly, or generally perpendicularly, from the side portion 46 toward the second side 16 of the seat 4. The side wall 42 may also include a rear portion that is joined with the rear wall. The side wall 42 and the first side 14 of the seat 4 define a recess 52 (FIGS. 1 and 2) forming a leg opening along the first side 14 of the seat 4. The front portion 48 of the side wall 42 and the front 12 of the seat 4 define a mouth 54 (FIG. 11) to the leg opening, such that the user may move his or her legs from in front of the seat through the mouth 54 and into the leg opening or recess 52 beneath the worksurface 50. Referring to FIGS. 11 and 13, an inner surface of the front portion 48 (i.e., the vertical surface of the front portion 48 facing toward the rear of the sofa 2) is spaced apart a distance M2 from the front 12 of the seat 4 and front edge of the opposite wall 44. The distance M2 is measured in a direction perpendicular to the front 12 of the seat 4. The free edge of the front portion 38 (i.e., the distal end of the front portion 38 opposite from the side portion 36) is spaced apart a distance M1 from the end of the front 12 of the seat. The distance M1 is measured in a direction parallel to the front 12 of the seat 4. The distances M1 and M2 together define the opening of the mouth 54.

The worksurface 50 is moveable between at least a first position (e.g., a sleep position shown FIGS. 2 and 3) and a second position (e.g., a work position shown in FIG. 1). When in the first position, the worksurface 50 is generally disposed in the recess 52 and is substantially aligned with a plane 56 (FIG. 5) defined by the upper support surface 8 of the seat 4. In this position, at least a portion of the worksurface 50 is covered by the backrest when the backrest 6 is moved to the second configuration. When in the second position, the worksurface 50 is vertically spaced above the plane 56 (FIG. 4) defined by the upper support surface 8 of the seat 4. In the illustrated embodiment, the worksurface 50 is vertically adjustable between the first and second positions. More particularly, the worksurface 50 moves linearly in a direction perpendicular to the plane 56 defined by the upper support surface 8 of the seat 4.

Referring to FIGS. 6-10, the convertible sofa 2 includes a worksurface assembly 60 that supports and moves the worksurface 50. The illustrated worksurface assembly 60 includes the worksurface 50, a support 62, and a carriage 64. The support 62 is disposed in and interior of, and concealed by, the side wall 42 of the sofa 2. As shown in FIG. 8, the support 62 includes an upper bracket 84 and a lower bracket 86, each of which is coupled to the side wall 42. The support 62 also includes a pole 70 and a guide member 74 extending between the brackets 84, 86. Referring back to FIG. 6, an opening 66 is formed in the side wall 42 to provide access to the support 62. In the illustrated embodiment, the opening 66 is a vertical slot. A cover 68 or trim is coupled to the support 62 and positioned around the periphery of the opening 66 to help define the opening 66.

As shown in FIG. 7, the carriage 64 is slideably mounted on the pole 70 of the support 62. The carriage 64 includes an attachment portion 72 extending through the guide member 74 of the support 62 and through the cover 68. Referring to FIG. 9, the carriage 64 has a housing with upper and lower openings 76, 78 through which the pole 70 extends. The carriage 64 also includes opposing pluralities of upper and lower bearings 80 that engage the pole 70 to facilitate movement of the carriage along the pole 70. The carriage 64 further includes at least one brake 82 that selectively engages the pole 70. In the illustrated embodiment, the brake 82 is a grip plate positioned within the housing. The grip plate has an aperture through which the pole 70 passes. The grip plate is normally tilted (e.g., obliquely angled) relative to a longitudinal axis of the pole 70 to grab the pole and inhibit movement of the carriage 64 along the pole 70.

As shown in FIG. 9, a release actuator 90 is connected to the brake 82. The release actuator 90 includes a cable 92 and a paddle switch 94 mounted to a lower surface of the worksurface 50. The paddle switch 94 is actuatable by a user by pushing or pulling upwardly and/or downwardly to release the brake 82. When the brake 82 is released (e.g., when the grip plate is oriented generally perpendicular to the longitudinal axis of the pole 70), the brake 82 disengages from the pole 70 so that the user may grasp and move the worksurface 50 to a desired height. For example, the worksurface 50 can be moved to a lowermost height wherein an upper surface 96 of the worksurface 50 is substantially flush with the plane 56 defined by the upper support surface 8 of the seat 4, to an uppermost height wherein the upper surface 96 of the worksurface 50 is aligned with or close to an upper surface of the side wall 42, or to any height therebetween. In the illustrated embodiment, the worksurface 50 is infinitely adjustable along the length of the pole 70 (i.e., the pole 70 does not include discrete locations at which the worksurface 50 must be positioned). In other embodiments, the worksurface 50 may only move to discrete locations along the pole 70. In some embodiments, the pole 70 may include stops (e.g., rubber bumpers) corresponding to the lowermost and/or uppermost positions of the worksurface 50.

Referring to FIG. 10, the worksurface 50 includes a bracket 98 secured to a bottom surface of the worksurface 50. The illustrated bracket 98 includes a plurality of support arms 100 extending outwardly from a hub or mounting portion 102. In the illustrated embodiment, the mounting portion 102 is defined by a pair of vertical flanges 104 that sandwich the attachment portion 72 (FIG. 7) of the carriage 64. The mounting portion 102 may be secured to the attachment portion 72 by threaded fasteners (e.g., bolts).

The worksurface 50 has a shape that substantially mates with the shape of the recess 52 defined by the first side 14 of the seat 4 and the side wall 42. In various embodiments, the worksurface 50 may have a polygonal shape when viewed from above. In one embodiment, the worksurface 50 may have an irregular polygonal shape when viewed from above, or more specifically, an irregular pentagonal shape when viewed from above. In the illustrated embodiment, the worksurface 50 has a front edge 104 that runs along the front portion 48 of the side wall 42, a first side edge 106 that runs along the side portion 46 of the side wall 42, a rear edge 108 that runs along the second portion 26 of the first side 14 of the seat 4, an angled side edge 110 that runs along the first angled portion 24 of the first side 14 of the seat 4, and a second side edge 112 running parallel to the first side edge 106. Referring to FIG. 11, the angled side edge 110 forms an acute angle $\alpha$ relative to the surface 34 of the first portion 30 of the backrest 4. In some embodiments, the acute angle $\alpha$ is between about 30 and 70 degrees. More particularly, the actuate angle $\alpha$ is between about 45 and 60 degrees. In the illustrated embodiment, the acute angle $\alpha$ is about 55 degrees. It should be readily apparent that this acute angle $\alpha$ is the same angle that the angled first portion 24 of the seat 2 forms with the back 10 of the seat 2. Referring back to FIG. 10, vertices or corners 114 between the edges 104, 106, 108, 110, 112, of the worksurface 50 are curved or rounded.

Figure 14:
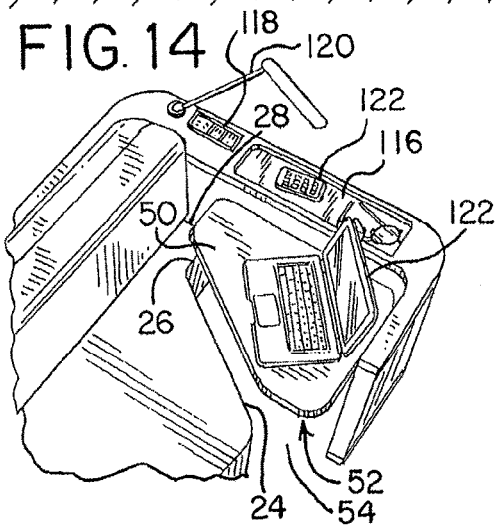
FIG. 14 is a partial perspective view of a convertible sofa with the worksurface assembly arranged on an opposite side of the sofa.

In addition to the worksurface assembly 60, the illustrated side wall 42 also supports additional accessories for use with the sofa 2. Referring to FIGS. 1, 11, and 14, a storage tray 116 is provided on the side wall 42. The storage tray 116 may also provide access to an interior storage space, such as a cubby defined in the interior of the side wall 42. The side wall 42 is configured with various utility outlets 118, which may include without limitation, AC power, USB ports, coaxial connections, and other types of utilities. The side wall 42 may also be configured with various controls, such as integrated equipment/appliance remotes, etc. In addition, a lighting component or lamp 120, including for example a personal light having a stem and lighting element, is connected to and extends upwardly from the side wall 42. Utility line(s), including power, USB, coaxial, and the like, run through the side wall 42 and are operably connected to the outlets 118 and the lamp 120. At opposite ends, the lines may be connected to various outlet sources available in the walls and/or floors of the room, and/or other surrounding structures, cords, etc.

Figure 15:
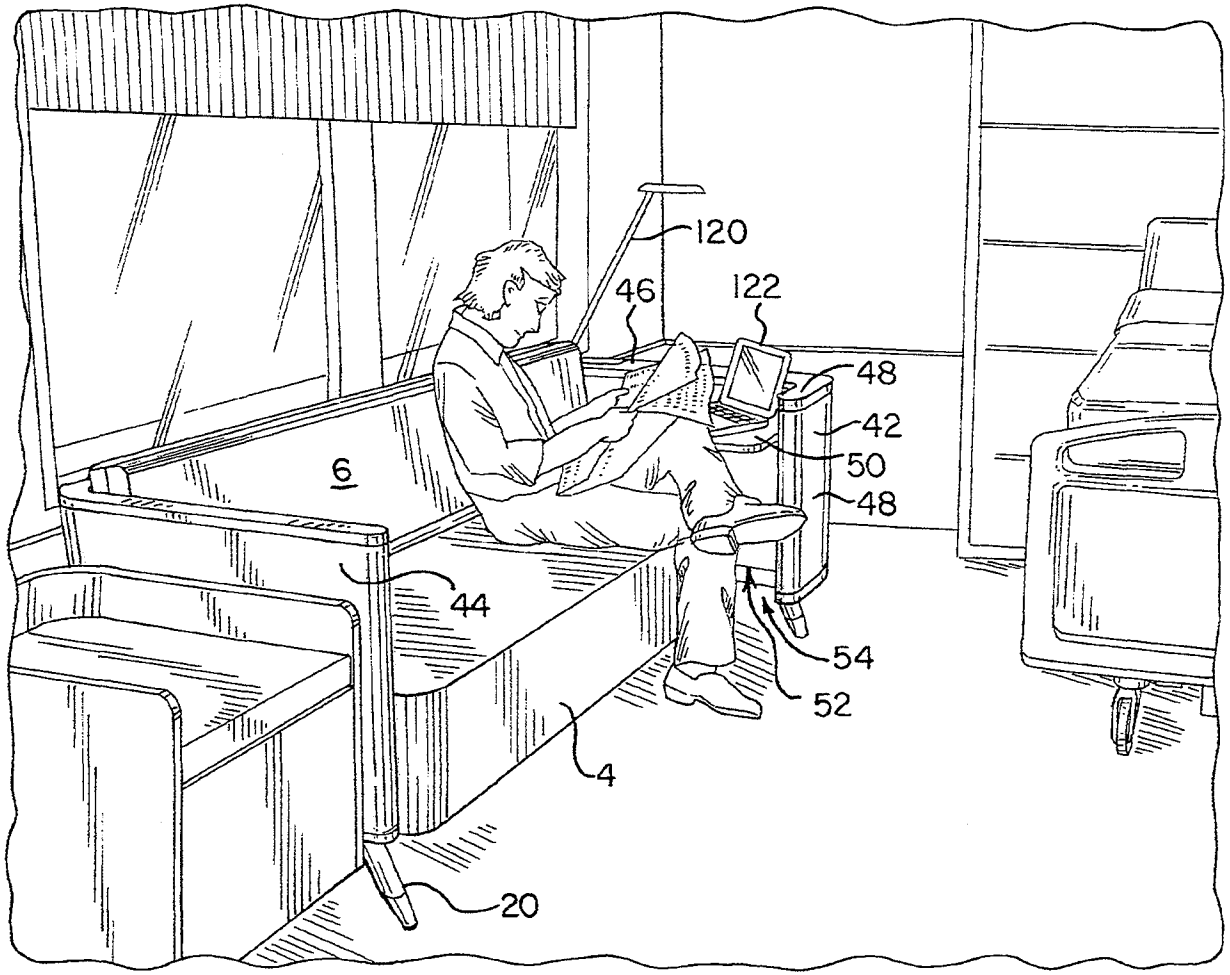
FIG. 15 is a perspective view of a user using the sofa in a sitting mode with the worksurface in a work position and the backrest in a work/sitting configuration.
Figure 16:
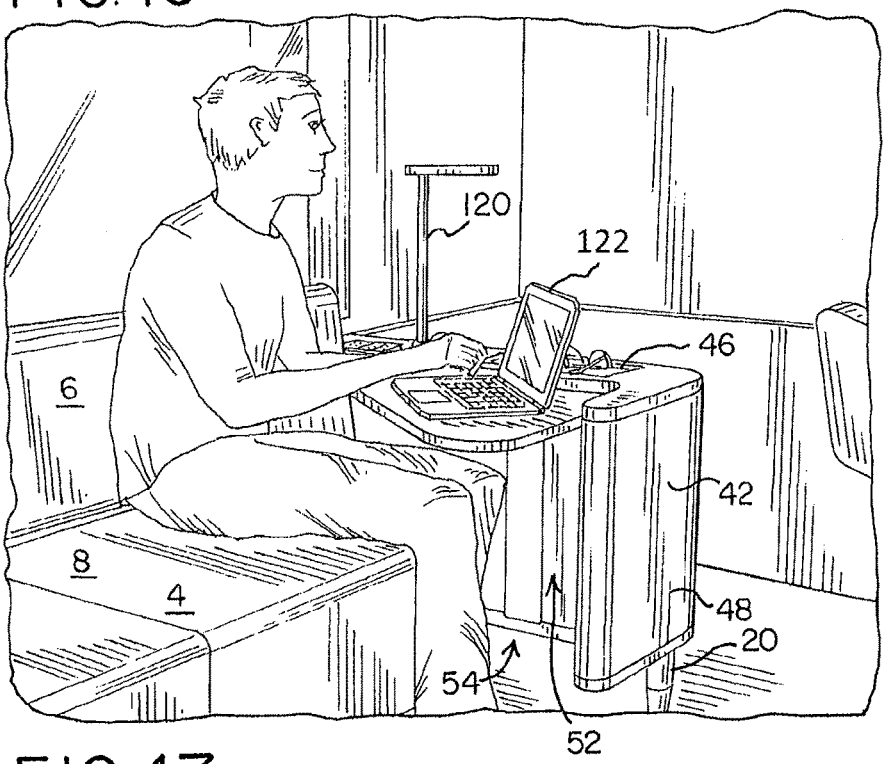
FIG. 16 is a partial perspective view of a user using the sofa in a work mode with the worksurface in the work position and the backrest in the work/sitting configuration.

In operation, the backrest 6 may be positioned in the work/sitting configuration, with the worksurface 50 in the work position, as shown, for example, in FIGS. 1 and 11-17. As shown in FIG. 15, in this configuration, the user may sit on any portion of the seat in a sitting mode with his or her legs positioned in front of the front of the seat 4. This position may be suitable, for example, to converse with someone sitting or lying across from them in another chair or bed, or to watch TV, read, etc. As shown in FIG. 16, the user may also position his or her legs beneath the worksurface 50 in the recess 52 in a work mode. In this position, the user may access items on the worksurface 50, such as an electronic device 122 (e.g., a computer, a mobile phone, a tablet, etc.). The side wall 42 provides a privacy barrier for the user in this mode. The electronic device(s) 122 may be plugged into the outlets 118 for access to power or data. By situating the worksurface 50 adjacent one end of the sofa 2, the seat 4 may be used by multiple users engaged in different tasks at the same time, with one or more users sitting on the seat, and another user accessing and using the worksurface 50. The worksurface 50 may also be used as a table for dining, card playing, and other common usages.

Figure 17:
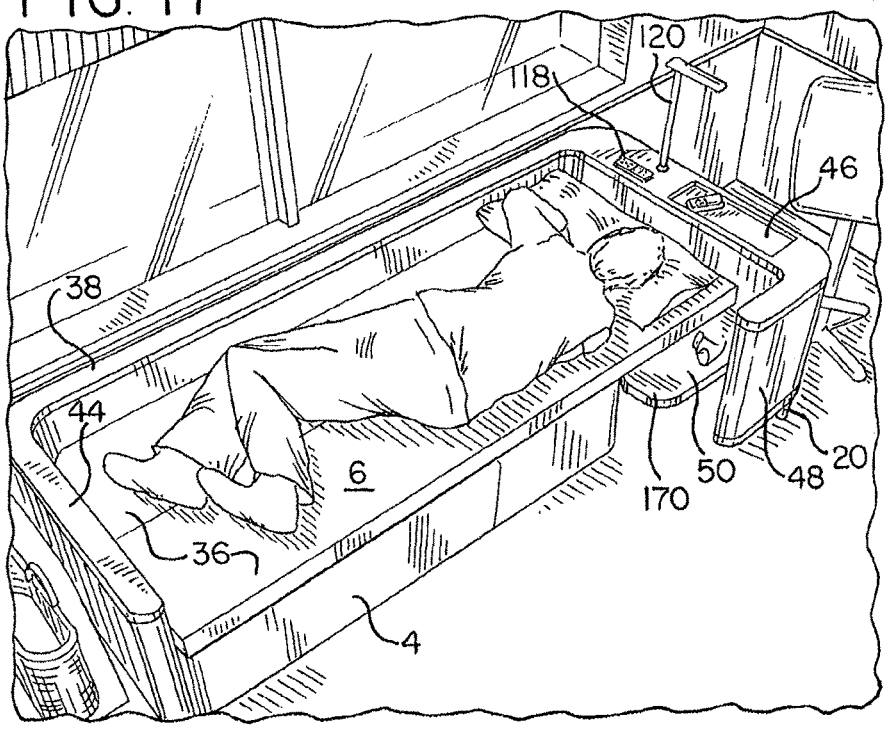
FIG. 17 is a perspective view of a user using the sofa in a sleep mode with the worksurface in a sleep position and the backrest in a sleep configuration.

If it is desired to use the sofa 2 in the sleep configuration, the user simply lowers the worksurface 50 by releasing the brake 82 via the actuator 94 until the worksurface 50 is substantially flush or aligned with the plane 56 defined by the upper support surface 8 of the seat 4. The user may then unfold the back 8 (i.e., pivot the portions 30, 32 relative to each other about the hinge 40), and position the back 8 such that it overlies and is supported by the upper support surface 8 and at least a portion of the worksurface 50. As shown in FIG. 17, at least a portion 170 of the worksurface 50 may remain exposed adjacent the unfolded back 4, thereby providing a convenient end table or night stand for locating personal items such as eye glasses or water. The user may then lie down on the backrest in a sleep mode. These steps may be reversed to return the sofa 2 to the work/sitting configuration.

The convertible sofa 2 may be used for sleeping, as well as proving a workstation, all within the same footprint of the system. The lightweight backrest 6 may be easily reconfigured to provide a bedding surface, which is well supported by the seat 4 and the worksurface 50. The configuration of the seat 4, the side wall 42, and the worksurface 50 provide ample leg room for a user, but still protect and provide a degree of privacy. Moreover, the position of the worksurface 50 adjacent one end of the sofa 2 provides a workspace while not interrupting the remaining available seating, which may be simultaneously used for conversation, viewing, resting, and other tasks.

The convertible sofa 2 may be particularly well suited for a patient room. For example, the sofa 2 provides a space that is welcoming and encourages a guest/patient conversation. The ample supply of accommodations, allowing for co-dining, working, reading, charging electronics, etc., enhances the guest experience, and thereby allows the guest to more effectively provide secondary care and encourages the guest/patient connection. At the same time, the sofa may be converted into a bed, such that the guest may remain with the patient, which may be particularly important in certain care situation (e.g., where the patient is a minor, or is delivering a baby).

Although the present invention has been described with reference to preferred embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof, which are intended to define the scope of the invention.

What is claimed is:

1. A convertible sofa comprising: a seat having an upper support surface, a back, a front, a first side, and a second side; a backrest moveable between a first configuration, in which the backrest is positioned along the back of the seat, and a second configuration, in which the backrest overlies the upper support surface of the seat; a side wall, the side wall and the first side defining a recess therebetween; and a worksurface coupled to the side wall and moveable between a first position, in which the worksurface is disposed within the recess and substantially aligned with a plane defined by the upper support surface of the seat, and a second position, in which the worksurface is spaced above the plane defined by the upper support surface of the seat; wherein at least a portion of the worksurface is covered by the backrest when the worksurface is in the first position and the backrest is in the second configuration; wherein the side wall includes a side portion extending between the back and the front of the seat, and a front portion extending generally perpendicularly from the side portion toward the second side of the seat; wherein the front of the seat is a generally planar surface, wherein an inner surface of the front portion of the side wall is spaced apart a first distance from the front of the seat measured in a direction perpendicular to the front, wherein a free edge of the front portion of the side wall is spaced apart a second distance from the front of the seat measured in a direction parallel to the front, and wherein the first and second distances define a mouth between the front portion of the side wall and the front of the seat that provides access to the recess.

2. The convertible sofa of claim 1, wherein a portion of the worksurface remains exposed when the backrest is in the second configuration to provide an end table.

3. The convertible sofa of claim 1, wherein the worksurface moves linearly in a direction perpendicular to the plane between the first position and the second position.

4. The convertible sofa of claim 3, further comprising:

a support positioned within the side wall, the support including a pole accessible through an opening in the side wall; and a carriage coupled to the worksurface and to the pole of the support, the carriage moveable along the pole to move the worksurface between the first position and the second position.

5. The convertible sofa of claim 4, wherein the carriage includes a brake that selectively engages the pole and a release actuator coupled to the brake, and wherein the release actuator is operable to disengage the brake from the pole to allow movement of the carriage along the pole.

6. The convertible sofa of claim 5, wherein the brake includes a grip plate that is titled relative to the pole to inhibit movement of the carriage along the pole.

7. The convertible sofa of claim 1, wherein the first side of the seat has an angled portion extending from the front toward the back of the seat, and wherein the angled portion is oriented at an acute angle relative to the back of the seat.

8. The convertible sofa of claim 7, wherein the acute angle is between about 30 and 70 degrees.

9. The convertible sofa of claim 1, wherein the worksurface has five edges arranged in an irregular polygonal shape when viewed from above.

10. The convertible sofa of claim 9, wherein vertices between the five edges of the worksurface are curved.

11. The convertible sofa of claim 1, wherein the backrest includes a first portion and a second portion that are pivotally coupled together, wherein the first and second portions are folded together when the backrest is in the first configuration, and wherein the first and second portions are unfolded to lay flat next to each other when the backrest is in the second configuration.

12. The convertible sofa of claim 11, wherein the first and second portions of the backrest are joined together by a living hinge.

13. The convertible sofa of claim 11, wherein the backrest is not secured to any other structures of the convertible sofa.

14. The convertible sofa of claim 11, wherein each of the first portion and the second portion has a first surface and a second surface, wherein the first surfaces of the first and second portions define a front and a back of the backrest when the backrest is in the first configuration, and wherein the second surfaces of the first and second portions face each other when the backrest is in the first configuration.

15. The convertible sofa of claim 14, wherein the second surfaces of the first and second portions define an upper surface of the backrest when the backrest is in the second configuration.

16. The convertible sofa of claim 14, wherein the second surfaces of the first and second portions contact each other when the backrest is in the first configuration.

17. The convertible sofa of claim 1, wherein the side wall supports a storage tray.

18. The convertible sofa of claim 1, wherein the side wall supports a utility outlet.

19. The convertible sofa of claim 1, wherein the side wall supports a lighting component.

20. A method of using a convertible sofa, the method comprising: providing a seat having an upper support surface, a back, a front, a first side, and a second side, providing a side wall, the side wall and the first side defining a recess therebetween; moving a worksurface between a first position, in which the worksurface is disposed within the recess and substantially aligned with a plane defined by the upper support surface of the seat, and a second position, in which the worksurface is spaced above the plane defined by the upper support surface of the seat; and moving a backrest between a first configuration, in which the backrest is positioned along the back of the seat, and a second configuration, in which the backrest overlies the upper support surface of the seat and at least a portion of the worksurface when the worksurface is in the first position; wherein the side wall includes a side portion extending between the back and the front of the seat, and a front portion extending generally perpendicularly from the side portion toward the second side of the seat; wherein the front of the seat is a generally planar surface, wherein an inner surface of the front portion of the side wall is spaced apart a first distance from the front of the seat measured in a direction perpendicular to the front, wherein a free edge of the front portion of the side wall is spaced apart a second distance from the front of the seat measured in a direction parallel to the front, and wherein the first and second distances define a mouth between the front portion of the side wall and the front of the seat that provides access to the recess.

* * * * *